US007796929B2

(12) United States Patent
Ebara et al.

(10) Patent No.: US 7,796,929 B2
(45) Date of Patent: Sep. 14, 2010

(54) METHOD OF DETECTING A PHASE DIFFERENCE OF IMAGE BEARING MEMBERS AND AN IMAGE FORMING APPARATUS USING THE METHOD

(75) Inventors: Joh Ebara, Kamakura (JP); Toshiyuki Uchida, Kawasaki (JP); Noriaki Funamoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 376 days.

(21) Appl. No.: 11/934,579

(22) Filed: Nov. 2, 2007

(65) Prior Publication Data

US 2008/0069604 A1 Mar. 20, 2008

Related U.S. Application Data

(63) Continuation of application No. 11/227,517, filed on Sep. 16, 2005, now Pat. No. 7,352,978.

(30) Foreign Application Priority Data

Sep. 16, 2004 (JP) ..... 2004-269841

(51) Int. Cl.
*G03G 15/01* (2006.01)

(52) U.S. Cl. ..... 399/301

(58) Field of Classification Search ..... 399/301, 399/167

See application file for complete search history.

(56) References Cited

U.S. PATENT DOCUMENTS

2004/0161263 A1* 8/2004 Ehara ..... 399/167
2005/0058470 A1 3/2005 Funamoto et al.
2005/0084293 A1 4/2005 Fukuchi et al.

FOREIGN PATENT DOCUMENTS

| | | |
|---|---|---|
| JP | 2000-284561 | 10/2000 |
| JP | 2002-207338 | 7/2002 |
| JP | 2002-244395 | 8/2002 |
| JP | 2003-149902 | 5/2003 |
| JP | 2003149902 A * | 5/2003 |
| JP | 2003-186348 | 7/2003 |

* cited by examiner

*Primary Examiner*—Quana M Grainger
(74) *Attorney, Agent, or Firm*—Oblon, Spivak, McClelland, Maier & Neustadt, L.L.P.

(57) ABSTRACT

An image forming apparatus uses a method of detecting a phase difference of the image bearing members such that an image transferring member receives a reference toner mark and a reference image pattern carried by and a reference image bearing member and corresponding image patterns carried by respective corresponding image bearing members for at least one circumferential length of each image bearing member perpendicular to the moving direction of the image transferring member, a plurality of detectors detect the reference and corresponding image patterns, and a controller controls the image bearing members to have a positional relation of the reference image bearing member and each corresponding image bearing member for which the sum of the elapsed time difference of the image pattern with respect to the reference image pattern is minimum.

20 Claims, 7 Drawing Sheets

METHOD OF DETECTING A PHASE DIFFERENCE OF IMAGE BEARING MEMBERS AND AN IMAGE FORMING APPARATUS USING THE METHOD

CROSS-REFERENCE TO RELATED APPLICATIONS

This application is a continuation of U.S. application Ser. No. 11/227,517, filed on Sep. 16, 2005 now U.S. Pat. No. 7,352,978, and is based upon and claims priority to Japanese patent application no. 2004-269841, filed in the Japan Patent Office on Sep. 16, 2004. The entire contents of each of these documents are incorporated herein by reference.

BACKGROUND OF THE INVENTION

1. Field of the Invention

The present invention generally relates to a method of detecting a phase difference of image bearing members and an image forming apparatus using the method. More particularly, the present invention relates to a method of detecting a phase difference caused by velocity fluctuations of image bearing members and an image forming apparatus using the method.

2. Discussion of the Background

In general, it is known that an image forming apparatus having a plurality of image bearing members may have a phase difference of toner images formed on the plurality of respective image bearing members when the toner images are sequentially overlaid onto an image transferring member or directly onto a recording medium. This is because fluctuations in the rotational speed of respective image bearing members may occur.

In some image forming apparatuses, the phase difference caused by the fluctuations in the rotational speed of the image bearing members is calculated based on patterns formed on the image transferring member so that the rotational speed of the image bearing members can be controlled to compensate for the phase difference. The positions of the patterns, however, may change when the patterns are formed because a deviation in thickness of the image transferring member can occur. This may result in degradation in accuracy of phase adjustment or phasing.

In different image forming apparatuses, marks are previously formed on an image transferring member to detect the position of the marks by a mark detecting sensor. However, additional costs may be required to provide such marks and the mark detecting sensor in a non-image forming portion of the image forming apparatus.

One way to effectively adjust color shifts of image bearing members is for an image forming apparatus to repeatedly form combinations of registration patterns of the respective colors so that a formation area thereof may be equal to one rotation portion of the image transferring member. The registration patterns are detected for respectively obtaining data of color shifts of cyan, magenta, and yellow images with respect to a black image by a same amount as a circumference of the image transferring member. According to the data of color shifts, components derived from rotational irregularity of an image bearing member and components derived from traveling irregularity of an image transferring member are extracted and then stored. In an image forming operation, phases of the image bearing member and the image transferring member are detected, and the data of color shifts having the above-described components are made in alignment with phases thereof. To eliminate the aligned color shifts, a correction pulse compensating a writing timing for each scanning line to the image bearing member of each color is generated. According to the correction pulse, respective LED arrays are driven.

Another way is to calculate a mean value of deviations of color marks. Color images are formed on respective image bearing members and transferred to a transfer sheet in an overlaying manner. As for the detection of the color shift in color image formation, a plurality of mark sets including the array of respective color marks arranged in the moving direction of an image transferring member are formed on the image transferring member. The respective color marks of the respective mark sets are detected by sensors so that the average value of the deviation of the same color marks on the different mark sets from respectively corresponding reference positions can be calculated. In such detection, the plurality of mark sets are formed within the range of one circumferential length of the image transferring member. The same color marks on the different mark sets are formed at the pitch of three fourth (¾) circumferential length of the image bearing member. The number of sets to be formed is eight or four. Only analog-to-digital (A/D) conversion data within the range from approximately 2V to approximately 3V is stored in association with respective scanning positions into a memory, and center points of the marks are calculated.

In the full-color copying machine of four-series tandem type, a correction value is set based on the phase difference of velocity change for one circumferential length of the image bearing member which is determined based on the halftone band of uniform density for each color recorded in a recording medium. Based on the correction value, the rotational speed of the image bearing member is controlled, that is, increased or decreased. Thereby, the phase of the velocity change for one circumferential length of the image bearing member is adjusted.

The above-described techniques used in the respective image forming apparatuses, however, require complex controlling and are associated with insufficient prevention for deterioration in accuracy of phase adjustment caused by deviations due to thickness in the image transferring member.

SUMMARY OF THE INVENTION

The present invention has been made in view of the above-discussed shortcomings of the background art.

An object of the present invention is to provide a novel method of detecting a phase difference of velocity fluctuations of image bearing members.

Another object of the present invention is to provide a novel image forming apparatus in which the above-described novel method is performed.

In one embodiment, a novel method of detecting a phase difference of a plurality of image bearing members which includes a reference image bearing member and corresponding image bearing members includes transferring a reference toner mark carried by the reference image bearing member onto an image transferring member, transferring a reference image pattern carried by the reference image bearing member onto the image transferring member by one or more circumferential length thereof perpendicular to a moving direction of the image transferring member, transferring a corresponding image pattern carried by each corresponding image bearing member onto the image transferring member by one or more circumferential length thereof perpendicular to the moving direction of the image transferring member, detecting the reference image pattern and the corresponding image pattern by a plurality of detectors, calculating a sum of an elapsed time difference of the corresponding image pattern with respect to the reference image pattern, changing a phase of each corresponding image bearing member with respect to the reference image bearing member, repeating the above-described steps at least once, and storing a positional relation of the reference image bearing member and each corresponding image bearing member where the sum of the elapsed time difference of the corresponding image pattern with respect to the reference image pattern is minimum.

Further, in one embodiment, a novel image forming apparatus includes an image transferring member, a plurality of image bearing members, a plurality of detectors, and a controller. The image transferring member is configured to receive and transfer a toner image. The plurality of image bearing members is configured to bear respective toner images on respective surfaces thereof, and includes a reference image bearing member configured to carry and transfer a reference toner mark and a reference image pattern onto the image transferring member, and corresponding image bearing members configured to carry and transfer a corresponding image pattern onto the image transferring member. The plurality of detectors are configured to detect the reference image pattern and the corresponding image pattern. The controller is configured to control the reference image bearing member and each corresponding image bearing member having a positional relation where a sum of an elapsed time differences between the reference image pattern and the corresponding image pattern is minimum.

Further, in one embodiment, a novel image forming apparatus includes an image transferring member, a plurality of image bearing members, a plurality of drive gears, a plurality of detectors, and a controller. The image transferring member is configured to receive and transfer a toner image. The plurality of image bearing members is configured to bear respective toner images on respective surfaces thereof, and includes a reference image bearing member configured to carry and transfer a reference toner mark and a reference image pattern onto the image transferring member, and corresponding image bearing members configured to carry and transfer a corresponding image pattern onto the image transferring member. The plurality of drive gears are configured to drive the plurality of image bearing members. The plurality of detectors are configured to detect a position of a marking material formed on one of each image bearing member and each drive gear so that a position of each image bearing member is detected. The controller is configured to control the reference image bearing member and each corresponding image bearing member having a positional relation where a sum of an elapsed time differences between the reference image pattern and the corresponding image pattern is minimum.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
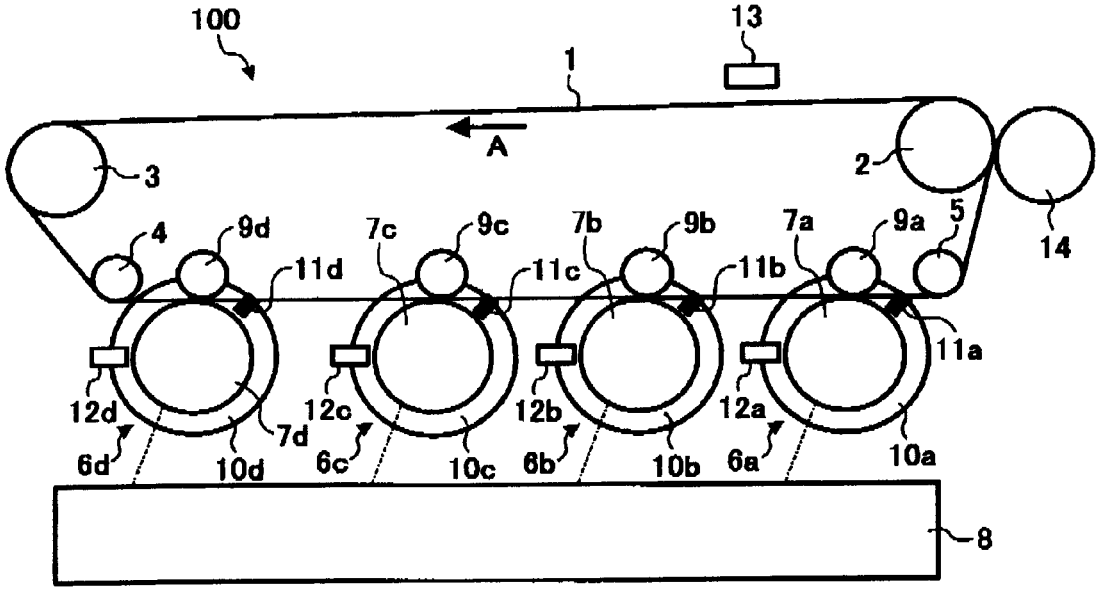
FIG. 1 is a schematic structure of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a structure of an image forming apparatus 100 is shown as one example of an electro photographic image forming apparatus according to exemplary feeding cassettes as a sheet feeding mechanism.

Referring to FIG. 1, a schematic structure of a color image forming apparatus 100 according to an exemplary embodiment of the present invention is described.

The color image forming apparatus 100 includes an intermediate transfer belt 1, four image forming units 6*a*, 6*b*, 6*c*, and 6*d*, an optical writing unit 8, bias rollers 9*a*, 9*b*, 9*c*, and 9*d*, image bearing member drive gears 10*a*, 10*b*, 10*c*, and 10*d*, a plurality of toner pattern detecting sensors 13, and an image transferring roller 14.

The intermediate transfer belt 1 serves as an image transferring member, and is wound around a plurality of rollers 2, 3, 4, and 5. The roller 2 serves as a drive roller to rotate the intermediate transfer belt 1 in a direction indicated by arrow A. Hereinafter, the roller 2 is referred to as a drive roller 2.

The image forming units 6*a*, 6*b*, 6*c*, and 6*d* are disposed below the intermediate transfer belt 1, each of which is held in contact with a moving surface of the intermediate transfer member 1. The image forming units 6*a*, 6*b*, 6*c*, and 6*d* include respective image bearing members 7*a*, 7*b*, 7*c*, and 7*d*. The image bearing members 7*a*, 7*b*, 7*c*, and 7*d* are drum-shaped image bearing members for black, magenta, cyan, and yellow toner images, respectively. The configurations of the image bearing members 7*a*, 7*b*, 7*c*, and 7*d* are identical to each other.

Unless specified, a term "image bearing member 7" will generally be used to refer to each or all of the image bearing members for black, magenta, cyan, and yellow toner images in a generic fashion.

The optical writing unit 8 is disposed below the image bearing members 7*a*, 7*b*, 7*c*, and 7*d* to emit respective laser light beams to irradiate respective surfaces of the image bearing members 7*a*, 7*b*, 7*c*, and 7*d* to form respective electrostatic latent images thereon.

The bias rollers 9*a*, 9*b*, 9*c*, and 9*d* are disposed at an inner surface of the intermediate transfer belt 1 to contact the surfaces of the image bearing members 7*a*, 7*b*, 7*c*, and 7*d*, respectively, via the intermediate transfer belt 1. The bias rollers 9*a*, 9*b*, 9*c*, and 9*d* apply respective biases to the intermediate transfer belt 1 to attract the toner images formed on the surfaces of the image bearing members 7*a*, 7*b*, 7*c*, and 7*d*.

The image bearing member drive gears 10*a*, 10*b*, 10*c*, and 10*d* correspond to the image bearing members 7*a*, 7*b*, 7*c*, and 7*d*, respectively. The image bearing member drive gears 10*a*, 10*b*, 10*c*, and 10*d* include respective markings 11*a*, 11*b*, 11*c*, and 11*d* thereon. The markings 11*a*, 11*b*, 11*c*, and 11*d* are used as reference points to detect rotational positions of the respective image bearing members 7*a*, 7*b*, 7*c*, and 7*d* in a rotational direction by respective image bearing member position sensors 12*a*, 12*b*, 12*c*, and 12*d*. The image bearing member position sensors 12*a*, 12*b*, 12*c*, and 12*d* detect the markings 11*a*, 11*b*, 11*c*, and 11*d*, respectively, on the corresponding image bearing member drive gears 10*a*, 10*b*, 10*c*, and 10*d* to detect the positions of the respective image bearing members 7*a*, 7*b*, 7*c*, and 7*d* in a belt traveling direction or rotational direction of the intermediate transfer belt 1.

The reference points detected by the image bearing member position sensors 12*a*, 12*b*, 12*c*, and 12*d* are not limited to the markings 11*a*, 11*b*, 11*c*, and 11*d*, but respective protrusions can be formed on the image bearing member drive gears 10*a*, 10*b*, 10*c*, and 10*d* as the reference points. When the protrusions are employed as the reference points, the image bearing member position sensors 12*a*, 12*b*, 12*c*, and 12*d* may be configured to be capable of detecting the protrusions.

The plurality of toner pattern detecting sensors 13 serving as detectors are positioned perpendicular to the belt traveling direction or rotational direction of the intermediate transfer belt 1 (that is, a lateral view of the cross section in FIG. 1). The plurality of toner pattern detecting sensors 13 detect a reference toner mark or toner patterns generated and formed by the image bearing members 7*a*, 7*b*, 7*c*, and 7*d* on the intermediate transfer belt 1.

The image transferring roller 14 transfers the toner image formed on the intermediate transfer belt 1 to a recording medium. The recording medium, for example a recording sheet, transparency sheet, etc., may be inserted from below (not shown in FIG. 1) and pass through a nip portion formed between the drive roller 2 and the image transferring roller 14.

Although not shown in FIG. 1, an electrostatic charging device (see FIG. 12), a toner image developing device, a drum cleaning device and the like may be arranged around each of the image bearing members 7*a*, 7*b*, 7*c*, and 7*d*.

Figure 2:
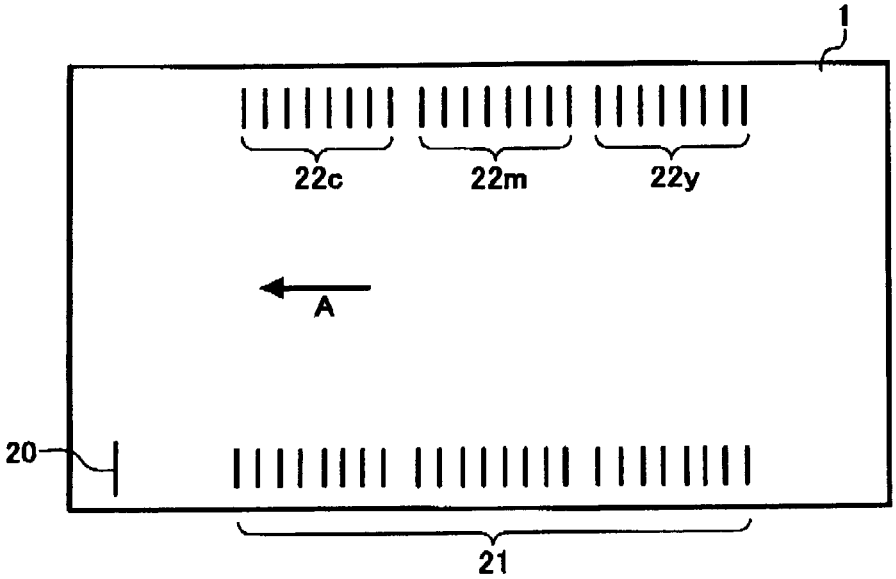
FIG. 2 is a drawing of patterns used for detecting fluctuations in a rotational speed of image bearing members.

Referring now to FIG. 2, a reference toner mark 20 and image patterns 21, 22*c*, 22*m*, and 22*y* formed on the intermediate transfer belt 1 are described. The reference toner mark 20 and the image patterns 21, 22*c*, 22*m*, and 22*y* are used to detect a difference of velocity fluctuations of the image bearing members 7*a*, 7*b*, 7*c*, and 7*d*.

In this embodiment, the image bearing member 7*a*, for example, for black color toner serves as a reference image bearing member. The image bearing member 7*a* carriers the reference toner mark 20 thereon to transfer it onto the intermediate transfer belt 1. Based on the reference toner mark 20, the image bearing member 7*a* then carries a reference image pattern 21 in a form of line images. The reference image pattern 21 is transferred on the intermediate transfer belt 1 by one or more circumferential length of the image bearing member 7*a*, perpendicular or vertical to the belt traveling or rotational direction A of the intermediate transfer belt 1. The image bearing members 7*b*, 7*c*, and 7*d* carry image patterns 22*c*, 22*m*, 22*y*, respectively. The image patterns 22*c*, 22*m*, and 22*y* are transferred in a form of line images onto the intermediate transfer belt 1 at a position in a moving direction same as the reference image pattern 21, by one or more circumferential length of the image bearing members 7*b*, 7*c*, and 7*d*, respectively, perpendicular or vertical to the belt traveling or rotational direction A of the intermediate transfer belt 1. The image patterns in line images of cyan 22*c*, magenta 22*m*, and yellow 22*y* may be detected by the toner pattern detecting sensor 13.

Although black line images 21 are used as the reference line images in the present embodiment, a line image of any other color can also be used as a reference image pattern.

According to the structure of the color image forming apparatus 100 in this embodiment, the image bearing member 7*a* for black color toner is disposed at a position upstream of and closest to the toner pattern detecting sensor 13. Therefore, when the image bearing member 7*a* for black color toner is employed as a reference image bearing member for forming the reference toner mark 20, a period of detection time taken by the toner pattern detecting sensor 13 may effectively be reduced. Hereinafter, the image bearing member 7*a* for black color toner is referred to as a "reference image bearing member", and the image bearing members 7*b*, 7*c*, and 7*d* are referred to as "corresponding image bearing member(s)" in the present invention.

Figure 3:
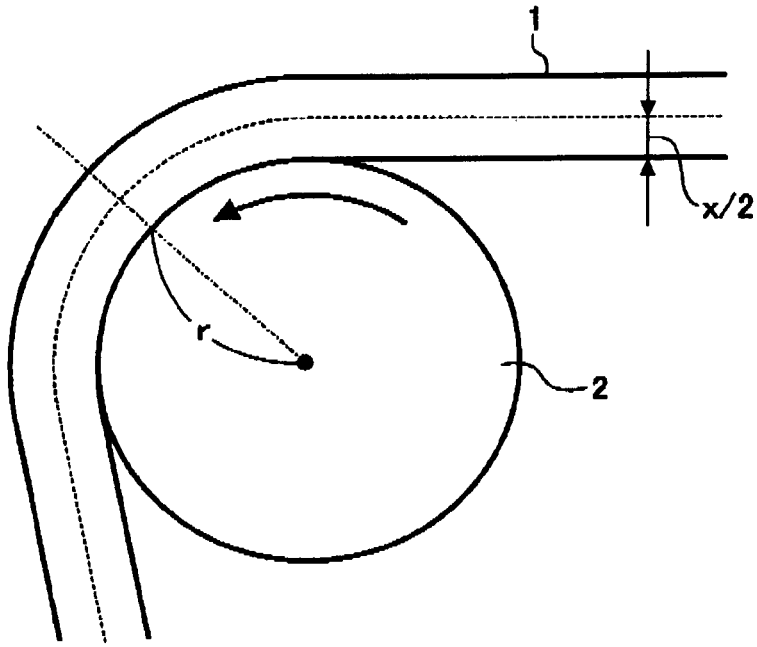
FIG. 3 is a relationship of a drive roller and an image transfer member for causing the velocity fluctuations.

Referring to FIG. 3, a toner image shift due to a deviation in thickness of the intermediate transfer belt 1 is described.

FIG. 3 shows that the intermediate transfer belt 1 is wound around the drive roller 2, assuming that "r" represents a radius, which is fixed, of the drive roller 2 and "x" represent a thickness of the intermediate transfer belt 1. The curved dotted line shows the centerline of the intermediate transfer belt 1 in thickness x, and the dashed line shows the belt movement position of the intermediate transfer belt 1. In this case, it is generally presumed that the velocity of the intermediate transfer belt 1 is equal to the velocity at the position of an average radius Ra, expressed as Ra=r+x/2, although this depends on the angle at which the intermediate transfer belt 1 is wound.

When an angular velocity of the drive roller 2 is represented as "ω1", the velocity "v" of the intermediate transfer belt 1 can be expressed as follows:

$$v=(r+x/2)\cdot\omega 1 \quad (1).$$

Assuming a thickness deviation "Δx" occurs in the intermediate transfer belt 1 during one cycle of rotation, and the deviation changes smoothly. When an angular velocity of the intermediate transfer belt 1 is represented as "ω2", the time of rotation of the intermediate transfer belt 1 is represented as "t", and the initial phase of the intermediate transfer belt 1 is represented as "θ", the velocity v of the intermediate transfer belt 1 having a deviation in thickness can be expressed, based on Equation (1), as follows:

$$v=(r+(x/2)+(\Delta x/2)\cdot\cos(\omega 2\cdot t+\theta))\cdot\omega 1 \quad (2).$$

A velocity deviation "Δv" of the intermediate transfer belt 1 can be obtained by subtracting Equation (1) from Equation (2) as follows:

$$\Delta v=(\Delta x/2)\cdot\cos(\omega 2\cdot t+\theta)\cdot\omega 1 \quad (3).$$

Figure 4:
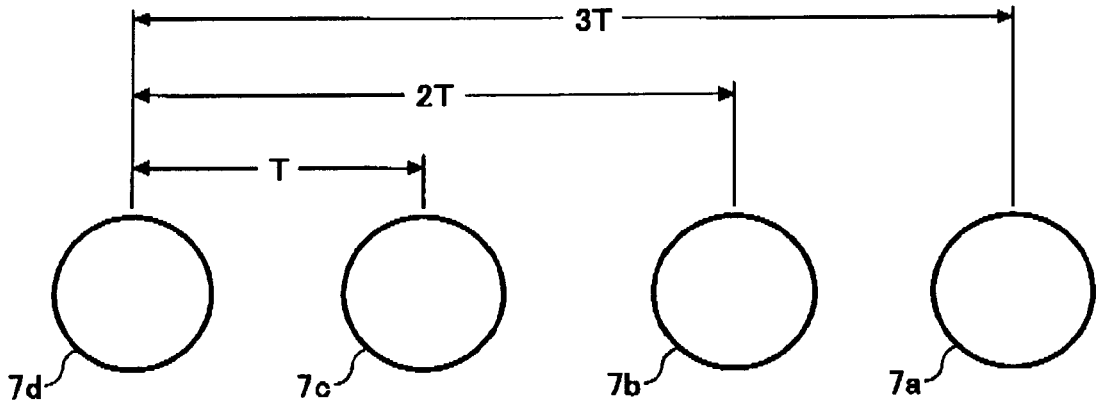
FIG. 4 is a drawing showing distances between the image bearing members.

As shown in FIG. 4, the time required for the intermediate transfer belt 1 to move from one image bearing member to the adjacent image bearing member between the reference and corresponding image bearing members 7*a*, 7*b*, 7*c*, and 7*d* is defined as "T". Since there are four image bearing members in the order of yellow, cyan, magenta, and black in the present invention, a highest deviation is generated between the corresponding image bearing member 7*d* for yellow image and the reference image bearing member 7*a* for black image. However, the alignment of the image bearing members is not limited to the above-described ordering. A general time deviation "Δy" can be obtained by Equation (4) as follows:

$$\begin{aligned}\Delta y &= \int_0^{3T}(\Delta x/2)\cdot\cos(\omega 2\cdot t+\theta)\cdot\omega 1\cdot dt \\ &= \{(\Delta x/2)\cdot(\omega 1/\omega 2)\cdot\sin(\omega 2\cdot t+\theta)\}_0^{3T}.\end{aligned} \quad (4)$$

Referring to FIGS. 5 to 11, image shifts due to a deviation in thickness of the image transferring member are described.

Figure 5:
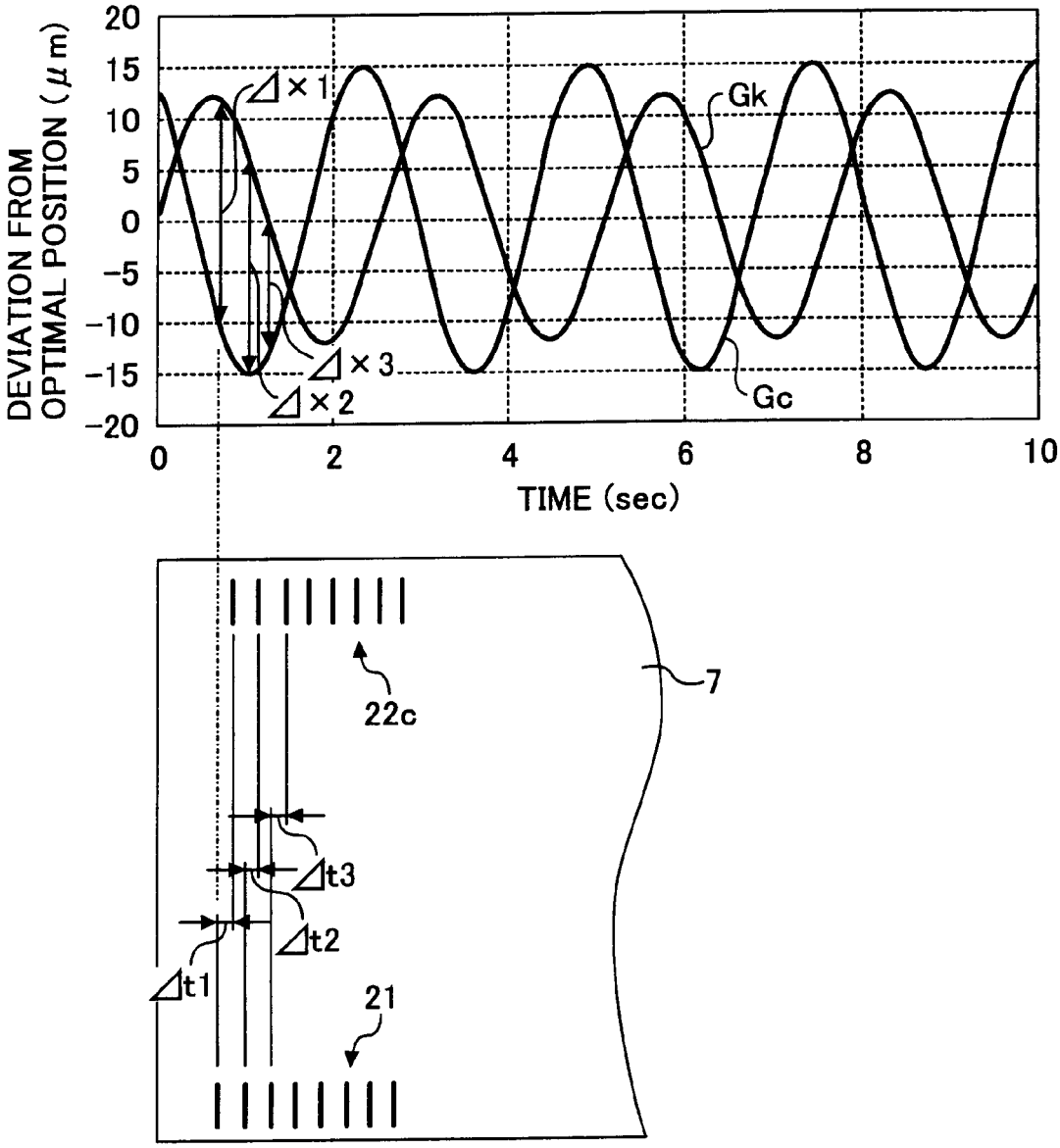
FIG. 5 is a graph showing a phase difference of elapsed time between a reference image pattern and a corresponding image pattern.

In a graph of FIG. 5, a curved line Gk indicates an image shift of a black toner image and a curved line Gc indicates an image shift of a cyan toner image so as to describe the phase difference between the reference black image pattern 21 and the corresponding cyan pattern 22*c* shown below the graph. Although the graph of FIG. 5 originally shows a composite line including a plurality of frequency waveforms generated based on a plurality of variable factors, the graph is simplified to show the frequency waveform of an image bearing member solely.

The difference of elapsed time between line images in the reference black image pattern 21 and line images in the corresponding cyan image pattern 22*c* may be calculated, and then the sum of the absolute values of time differences may be obtained. Thus, the time difference between the corresponding cyan image pattern 22*c* and the reference black image pattern 21, ΔTC−K, can be expressed as follows:

$$\Delta TC-K=|\Delta t1|+|\Delta t2|+|\Delta t3|\ldots+|\Delta tn| \quad (5).$$

The color shifts of toner images in the belt traveling direction or rotational direction (the sub-scanning direction) of the intermediate transfer belt 1 may be caused, for example, by the following factors:

Δtdr: Deviation caused by velocity fluctuations in the rotational speed of a drum-shaped image bearing member, Δtblt: Deviation caused by a deviation in thickness of the intermediate transfer belt 1, Δtreg: Deviation caused by shift, and Δtsq: Deviation caused by skew.

Eccentricity of the drive roller 2 can also cause the deviation. However, the eccentricity of the drive roller 2 can be reduced or even prevented by making the length of the outer circumference of the drive roller 2 same as the distance between adjacent image bearing members.

The sum, ΔTC−K, of the deviations caused by the above-described factors may be expressed as follows:

$$\Delta TC-K=\Delta tdr+\Delta tblt+\Delta treg+\Delta tsq \quad (6).$$

From Equations 5 and 6, the time difference of the cyan image pattern 22*c* and the reference black image pattern 21 can be expressed as follows:

$$|\Delta t1|+|\Delta t2|+|\Delta t3|\ \ .\ \ .\ \ .\ \ +|\Delta tn|=\Delta tdr+\Delta tblt+\Delta treg+\Delta tsq \quad (7).$$

In Equation 7, the deviation caused by shift Δtreg and the deviation caused by skew Δtsq often change due to a rise in temperature of optical elements included in the optical writing unit 8. Since the color image forming apparatus 100 can form patterns in a short time, it may be assumed that the temperature in the optical writing unit 8 does not rise so high to cause the above-described change. Thus, the deviation caused by shift Δtreg and the deviation caused by skew Δtsq may be considered to remain constant.

Further, the deviation caused by the thickness deviation Δtblt can be maintained at a fixed value by constantly forming the patterns at the same position on the intermediate transfer belt 1 in the belt traveling or rotational direction.

Therefore, it can be assumed that the sum of the deviations Δtblt+Δtreg+Δtsq is a fixed value represented by "k", and Equation 7 can be expressed as follows:

$$|\Delta t1|+|\Delta t2|+|\Delta t3|\ldots+|\Delta tn|=\Delta tdr+k \quad (8).$$

Equation 8 may provide the positional relation of the image bearing member drive gears 10*a*, 10*b*, 10*c*, and 10*d* where the sum of the elapsed time differences between the line images of the reference black image pattern 21 and the line images of the corresponding cyan image pattern 22*c* is the relatively lowest or even the minimum. Hence, the positional relation of the reference and corresponding image bearing members 7*a*, 7*b*, 7*c*, and 7*d* where the phase difference of line images caused by fluctuations in the rotational speed is the relatively lowest or even the minimum may be obtained.

To adjust the phase position of each of the reference and corresponding image bearing members 7*a*, 7*b*, 7*c*, and 7*d*, the above-described positional relation may be stored in a memory (not shown). A controller (not shown) may control to change and adjust the phases of the corresponding image bearing members 7*b*, 7*c*, and 7*d* with respect to the reference image bearing member 7*a*, and repeat the above-described operation for more than one time. According to results of the above-described repetitive operations, the positional relation of the reference and corresponding image bearing members 7*a*, 7*b*, 7*c*, and 7*d* where the sum of the elapsed time differences between the line images of the reference black image pattern 21 and each of the other image patterns 22*c*, 22*m*, and 22*y* is minimum may be stored, thereby adjusting the phases of the reference and corresponding image bearing members 7*a*, 7*b*, 7*c*, and 7*d*. In the above-described adjustment, the image bearing member position sensors 12*a*, 12*b*, 12*c*, and 12*d* detect the markings 11*a*, 11*b*, 11*c*, and 11*d*, respectively, so as to detect the position of each of the reference and corresponding image bearing members 7*a*, 7*b*, 7*c*, and 7*d* in the rotational direction where the sum of the elapsed time differences between the line images of the reference black image pattern 21 and each of the other image patterns 22*c*, 22*m*, and 22*y* is minimum.

To form an image pattern at a position same as the other image patterns on the intermediate transfer belt 1 in the belt traveling or rotational direction thereof, the reference image bearing member 7*a* for black image may carry the reference toner mark 20 including a toner image to transfer it onto the intermediate transfer belt 1. After the plurality of toner pattern detecting sensors 13 detect the reference toner mark 20 formed on the intermediate transfer belt 1, the reference image bearing member 7*a* may transfer the reference black image pattern 21 carried thereby onto the intermediate transfer belt 1. Then, at the same position of the intermediate transfer belt 1 in the belt traveling or rotational direction as the reference image pattern 21, corresponding image patterns 22*c*, 22*m*, and 22*y* carried by the corresponding image bearing members 7*b*, 7*c*, and 7*d* may be transferred.

With the above-described operations, the phases of the reference and corresponding image bearing members 7*a*, 7*b*, 7*c*, and 7*d* may easily be adjusted. However, when the reference black image pattern 21 and the corresponding image pattern 22*c* are formed on different positions on the intermediate transfer belt 1, Δx may change as shown in FIG. 6.

Figure 6:
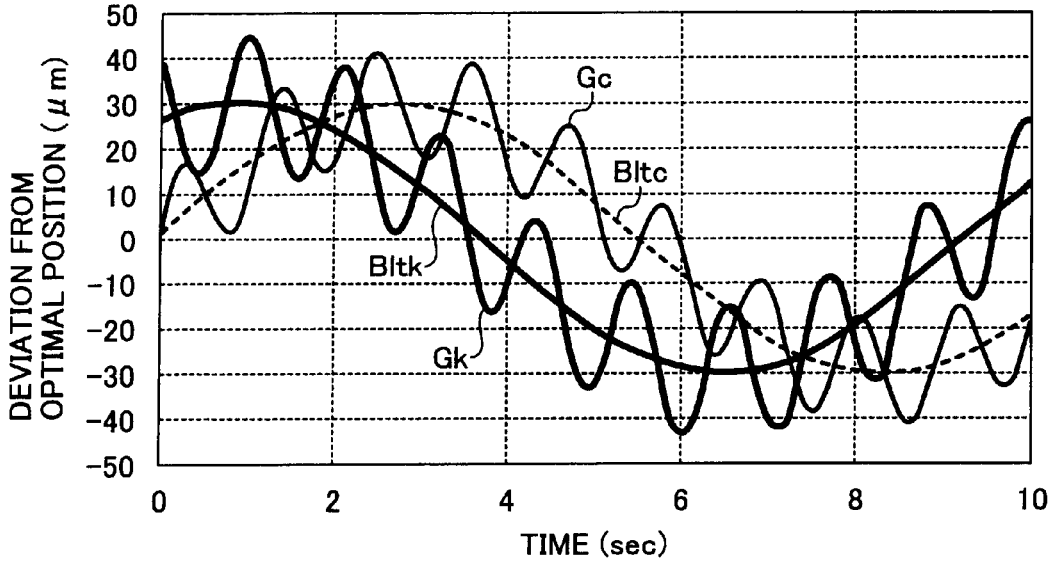
FIG. 6 is a graph showing affects exerted due to deviations in thickness of the image transfer member.
Figure 7:
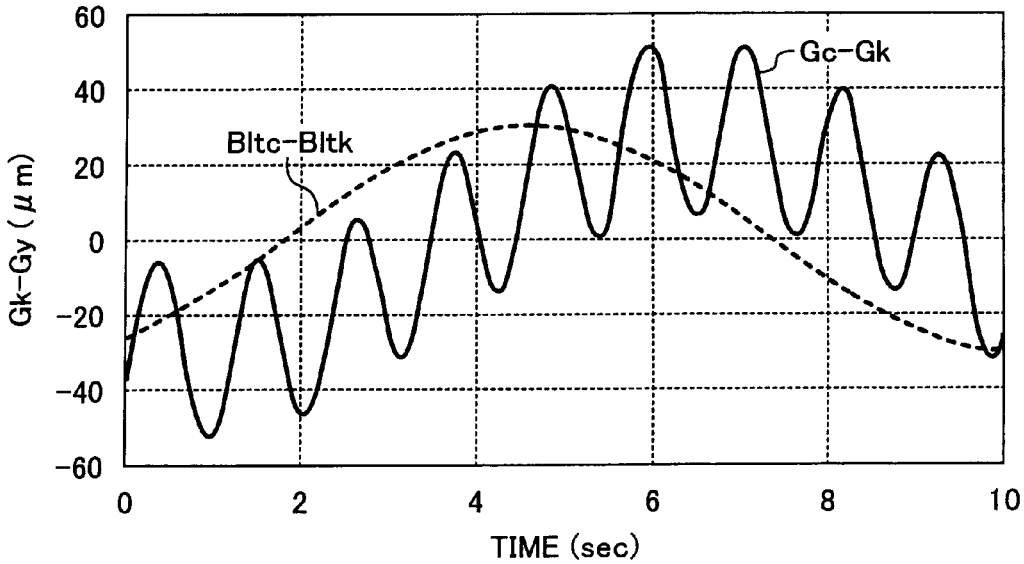
FIG. 7 is a graph showing the phase difference of the image bearing members according to a result of FIG. 6.

In a graph of FIG. 6, curved lines Bltk and Bltc show affects exerted due to the deviations in thickness of the intermediate transfer belt 1. The curved line Bltk indicates a component of image shift of the black toner image due to the deviation of the intermediate transfer belt 1 and the curved line Bltc indicates a component of image shift of the cyan toner image due to the deviation of the intermediate transfer belt 1. A graph of FIG. 7 shows a curved line Gc-Gk indicating the phase difference of the image shifts between the black and cyan toner images.

Figure 8:
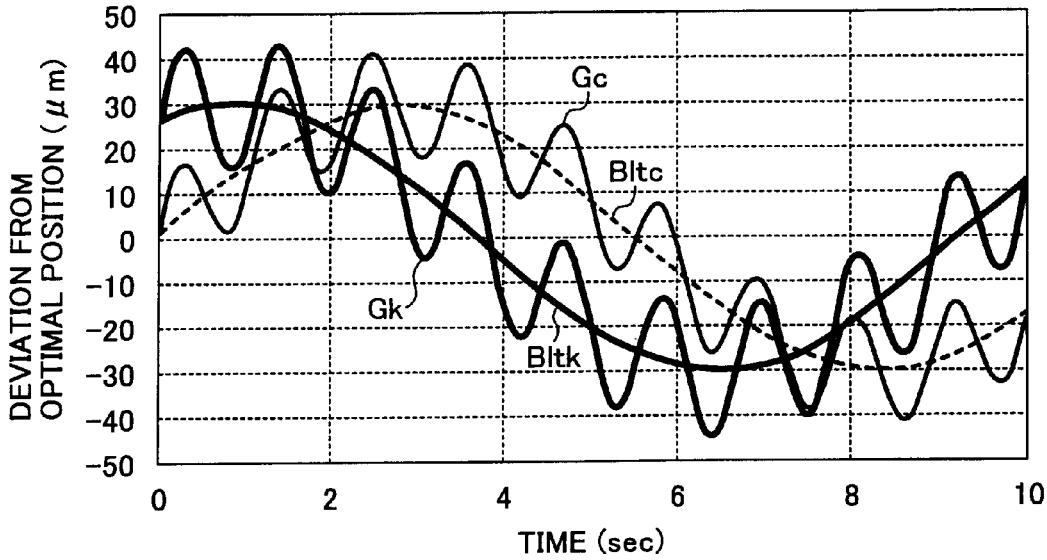
FIG. 8 is a graph indicating an optimal phase difference of the image bearing members when the reference image pattern and the corresponding image pattern are formed at a position same as the patterns shown in FIG. 6.
Figure 9:
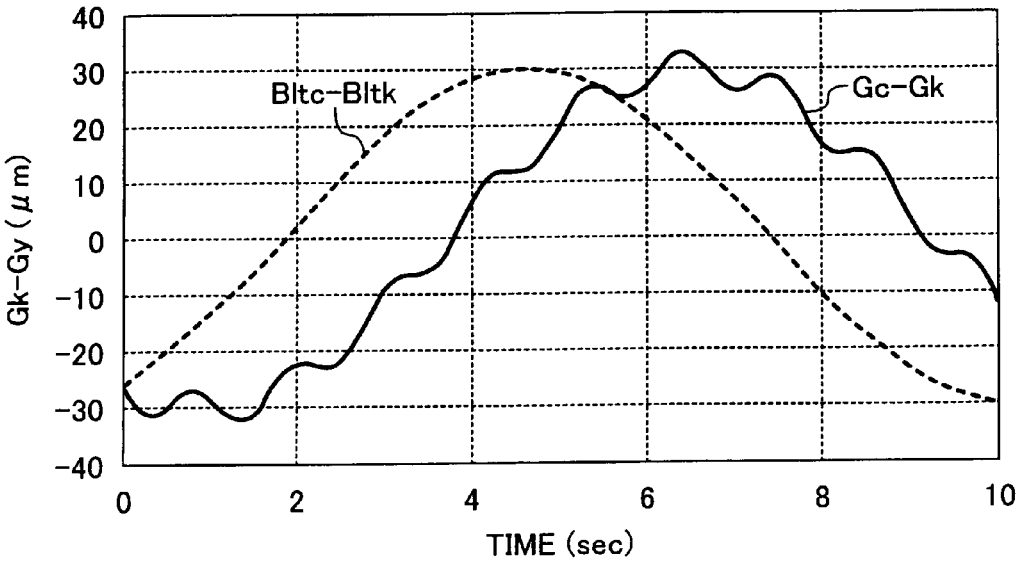
FIG. 9 is a graph showing the phase difference of the image bearing members when a curved line thereof is formed same as that of FIG. 7.

FIG. 8 shows a graph indicating the optimal phase difference between the reference image bearing members 7*a* for black toner image and the corresponding image bearing member 7*c* for cyan toner images when the reference black image pattern 21 and the corresponding cyan image pattern 22*c* are formed on the intermediate transfer belt 1 at a position same as the patterns shown in FIG. 6. The curved line Bltc-Bltk of FIG. 9 is formed same as that of FIG. 7. That is, the affects exerted due to the deviations in thickness of the intermediate transfer belt 1 are eliminated.

Figure 10:
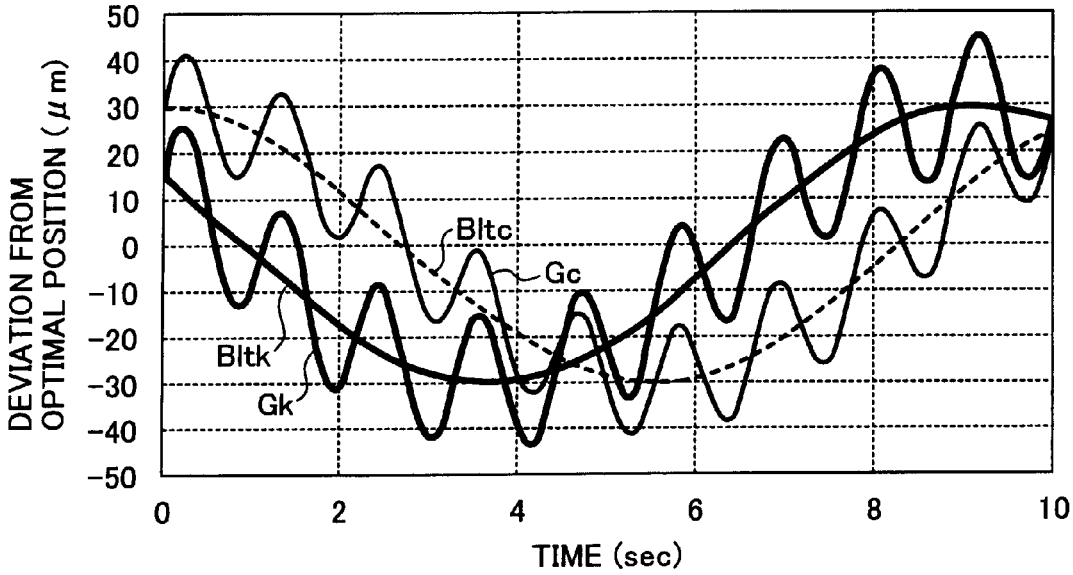
FIG. 10 is a graph indicating an optimal phase difference of the image bearing members when the reference image pattern and the corresponding image pattern are formed at a position different from the patterns shown in FIG. 6.
Figure 11:
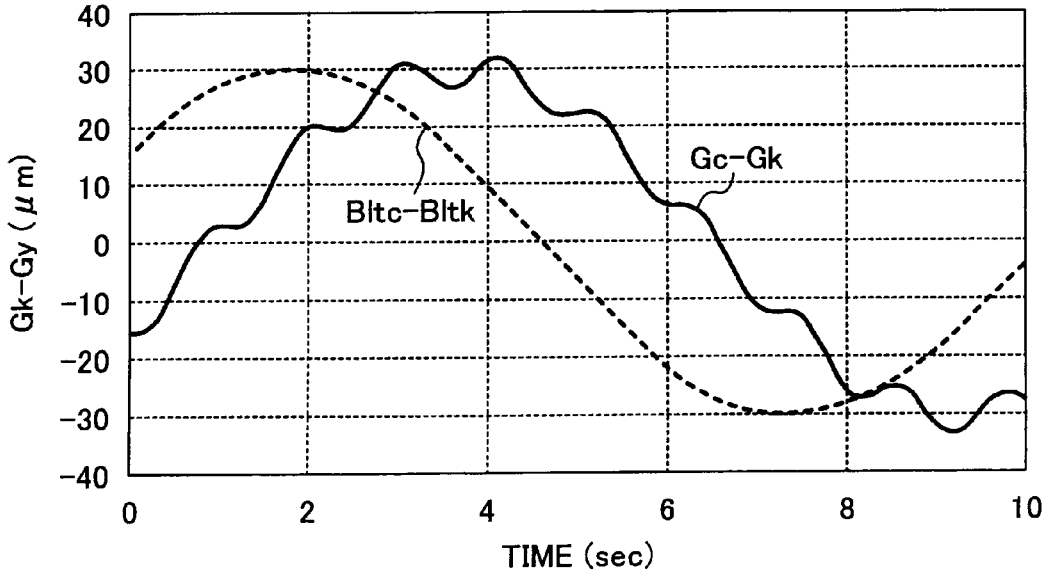
FIG. 11 is a graph showing the phase difference of the image bearing members when a curved line thereof is formed different from that of FIG. 7.

FIG. 10 shows a graph indicating the optimal phase difference between the reference and corresponding image bearing members for black and cyan toner images when the reference black image pattern 21 and the corresponding cyan image pattern 22*c* are formed on the intermediate transfer belt 1 at a position different from the patterns shown in FIG. 6. The curved line Bltc-Bltk of FIG. 11 is formed different from that of FIG. 7. That is, the affects exerted due to the deviations in thickness of the intermediate transfer belt 1 are not eliminated.

Accordingly, the phases of the reference and corresponding image bearing members 7*a*, 7*b*, 7*c*, and 7*d* may easily be adjusted by forming the reference black image pattern 21 and the corresponding image patterns 22*c*, 22*m*, and 22*y* at the same position on the intermediate transfer belt 1 in the belt traveling or rotational direction thereof.

Figure 12:
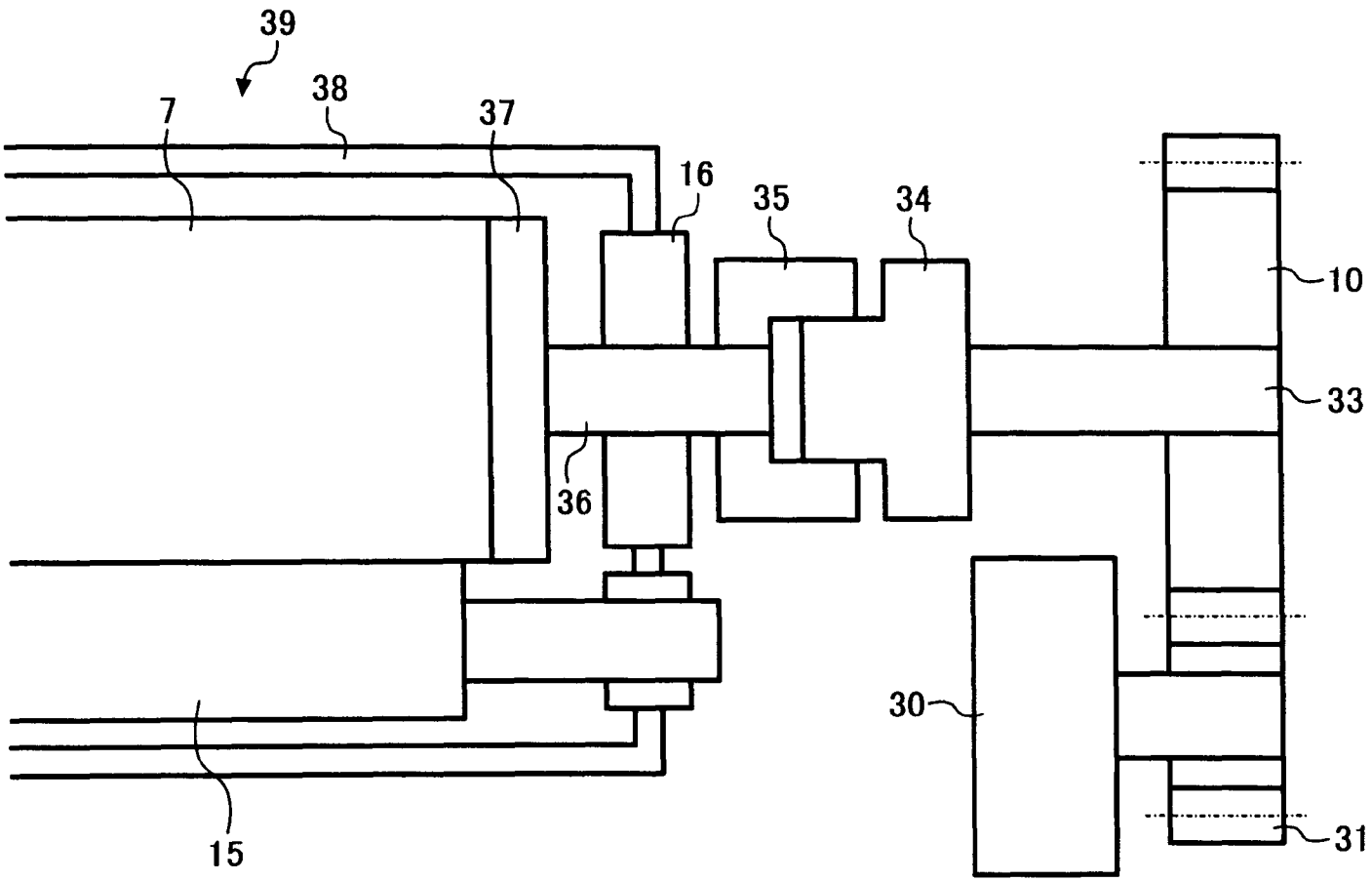
FIG. 12 is a schematic structure of a process cartridge included in the image forming apparatus of FIG. 1.

Referring to FIG. 12, a schematic structure of one of process cartridges 39 including a corresponding one of the above-described image forming units 6*a*, 6*b*, 6*c*, and 6*d* is described. The configurations of the process cartridges 39*a*, 39*b*, 39*c*, and 39*d* (not shown) are identical to each other, except for colors used for respective toner images formed thereon. In FIG. 12, the process cartridges and the components used in the respective process cartridges in common may be referred to without suffixes. For example, a term "image bearing member 7" will generally be used to refer to each or all of the image bearing members 7*a*, 7*b*, 7*c*, and 7*d* for black, cyan, magenta, and yellow toner images.

The process cartridge 39 of FIG. 12 includes the charging roller 15 and a bearing member 16. The charging roller 15 charges the surface of the image bearing member 7. The bearing member 16 is supported by a housing 38 of the process cartridge 39. The rotation force of the motor 30 is transmitted to a motor gear 31, the image bearing member gear 10 (also shown in FIG. 1), a drive shaft 33, a drive joint 34, an image bearing member joint 35, an image bearing member shaft 36, an image bearing member flange 37, and the image bearing member 7.

Thus, even when the image forming unit 6 is integrally mounted as a process cartridge, the image shift of the toner images caused by the phase difference of velocity fluctuations of the reference and corresponding image bearing members 7*a*, 7*b*, 7*c*, and 7*d* may be reduced.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed as new and desired to be secured by Letters Patent of the United States is:

1. An image forming apparatus, comprising:

an image transferring member configured to receive and transfer a toner image;

a plurality of image bearing members configured to bear respective toner images on respective surfaces thereof, the plurality of image bearing members including, a first image bearing member configured to carry and transfer a reference image pattern onto the image transferring member; and at least one other image bearing member configured to carry and transfer a corresponding image pattern onto the image transferring member;

at least one detector configured to detect a time that the reference image pattern and each corresponding image pattern pass the at least one detector;

a storing unit configured to store a minimum value of a sum of elapsed time differences between the reference image pattern and each corresponding image pattern; and a controller configured to control the first image bearing member and each of the at least one other image bearing member to have a positional relation for which the sum of elapsed time differences between the reference image pattern and each corresponding image pattern is the minimum value.

2. The image forming apparatus according to claim 1, wherein the reference image pattern and the corresponding image pattern are formed by at least one circumferential length thereof on the image transferring member, perpendicular to a moving direction of the image transferring member.

3. The image forming apparatus according to claim 1, wherein each image bearing member is drum-shaped.

4. The image forming apparatus according to claim 1, wherein each image bearing members has a same configuration.

5. The image forming apparatus according to claim 1, further comprising:

protrusions on drive gears of each image bearing member.

6. The image forming apparatus according to claim 5, wherein the protrusions are detected by a plurality of image bearing member position sensors and used as reference points.

7. The image forming apparatus according to claim 2, wherein a reference image bearing member is disposed at a most proximate portion from the at least one detector in an upstream moving direction of the image transferring member.

8. The image forming apparatus according to claim 7, wherein each image bearing member is integrally mounted to a process cartridge which includes at least a charger configured to charge a surface of each corresponding image bearing member.

9. The image forming apparatus according to claim 7, wherein the process cartridge to which each image bearing member is integrally mounted includes a motor and motor gear.

10. The image forming apparatus according to claim 9, wherein the motor and motor gear are configured to drive the image bearing member using a drive shaft, a drive joint, an image bearing member shaft, an image bearing member joint, and an image bearing member flange.

11. An image forming apparatus, comprising:

means for transferring a toner image;

means for carrying respective toner images including, first means for forming a reference image pattern onto the means for transferring; and second means for forming a corresponding image pattern onto the means for transferring;

means for detecting a time that the reference image pattern and each corresponding image pattern pass the means for detecting;

means for storing a minimum value of a sum of elapsed time differences between the reference image pattern and each corresponding image pattern; and means for controlling the first and second means for forming to have a positional relation for which the sum of elapsed time differences between the reference image pattern and each corresponding image pattern is the minimum value.

12. The image forming apparatus according to claim 11, wherein the reference image pattern and the corresponding image pattern are formed by at least one circumferential length thereof on the means for transferring, perpendicular to a moving direction of the means for transferring.

13. The image forming apparatus according to claim 11, wherein the first means for forming a reference image pattern and the second means for forming a corresponding image pattern are drum-shaped.

14. The image forming apparatus according to claim 11, wherein the first means for forming a reference image pattern and the second means for forming a corresponding image pattern have a same configuration.

15. The image forming apparatus according to claim 11, further comprising:

protrusions on drive gears of the first means for forming a reference image pattern and the second means for forming a corresponding image pattern.

16. The image forming apparatus according to claim 15, wherein the protrusions are detected by a plurality of means for sensing and used as reference points.

17. The image forming apparatus according to claim 12, wherein means for forming a reference image pattern are disposed at a most proximate portion from the plurality of means for detecting in an upstream moving direction of the image transferring member.

18. The image forming apparatus according to claim 17, wherein the first means for forming a reference image pattern and the second means for forming a corresponding image pattern are each integrally mounted to a process cartridge which includes at least a charger configured to charge a surface of each of the first means for forming a reference image pattern and the second means for forming a corresponding image pattern.

19. The image forming apparatus according to claim 18, wherein the process cartridge to which each the first means for forming a reference image pattern and the second means for forming a corresponding image pattern are integrally mounted includes a motor and motor gear.

20. The image forming apparatus according to claim 19, wherein the motor and motor gear are configured to drive the image bearing member using a drive shaft, a drive joint, an image bearing member shaft, an image bearing member joint, and an image bearing member flange.

* * * * *